US006016125A

United States Patent [19]

Johansson

[11] Patent Number: 6,016,125

[45] **Date of Patent: *Jan. 18, 2000**

[54] ANTENNA DEVICE AND METHOD FOR PORTABLE RADIO EQUIPMENT

[75] Inventor: Nils Anders Johansson, Lund, Sweden

[73] Assignee: Telefonaktiebolaget LM Ericsson, Stockholm, Sweden

[ * ] Notice: This patent issued on a continued prosecution application filed under 37 CFR 1.53(d), and is subject to the twenty year patent term provisions of 35 U.S.C. 154(a)(2).

[21] Appl. No.: 08/919,256

[22] Filed: Aug. 28, 1997

[30] Foreign Application Priority Data

Aug. 29, 1996 [SE] Sweden ..... 9603136

[51] Int. Cl.[7] ..... H01Q 1/24

[52] U.S. Cl. ..... 343/702; 343/901

[58] Field of Search ..... 343/702, 900, 343/901, 895; H01Q 1/24

[56] References Cited

U.S. PATENT DOCUMENTS

| | | | |
|---|---|---|---|
| 5,255,001 | 10/1993 | Tamura et al. | 343/702 |
| 5,579,023 | 11/1996 | Blaese | 343/851 |

FOREIGN PATENT DOCUMENTS

| | | |
|---|---|---|
| 0 511 577A2 | 11/1992 | European Pat. Off. . |
| 0 516 490A2 | 12/1992 | European Pat. Off. . |
| 0 522 806A2 | 1/1993 | European Pat. Off. . |
| 0 660 440A1 | 6/1995 | European Pat. Off. . |
| 0 668 060A2 | 8/1995 | European Pat. Off. . |
| 0 676 824A1 | 10/1995 | European Pat. Off. . |
| 0 736 925A2 | 10/1996 | European Pat. Off. . |
| 92/16980 | 10/1992 | WIPO . |
| 94/10720 | 5/1994 | WIPO . |
| 94/28593 | 12/1994 | WIPO . |

*Primary Examiner*—Michael C. Wimer
*Attorney, Agent, or Firm*—Burns, Doane, Swecker & Mathis, L.L.P.

[57] ABSTRACT

The invention relates to an antenna device for portable radio equipment such as mobile telephones (10) and a method for producing the antenna device. Mobile telephone antennas should have good receiving sensitivity and at the same time be compact. An antenna which can be folded down, folded up or retracted into a mobile telephone becomes compact but the receiving sensitivity becomes bad. A solution is an antenna device which comprises two antennas, a primary antenna (11) and a secondary antenna (12). The primary antenna can take up two positions and is always connected to the radio circuits (16) of the mobile telephone. The secondary antenna is a small and compact antenna. When the mobile telephone is in the paging position, the primary antenna is placed in the folded down, folded up or retracted-in position, wherein the secondary antenna is also connected to the radio circuits. The two antennas form an antenna device which has good receiving sensitivity and is compact.

14 Claims, 4 Drawing Sheets

ANTENNA DEVICE AND METHOD FOR PORTABLE RADIO EQUIPMENT

TECHNICAL FIELD

The present invention relates to an antenna device intended to be used in portable radio equipment, such as mobile telephones etc. The invention relates also to a method for producing said antenna device.

STATE OF THE ART

An antenna which is to be used in portable radio equipment should have good receiving sensitivity and at the same time be compact. These two characteristics can be difficult to combine wherefore a compromise often becomes necessary.

The expression portable radio equipment includes all portable equipment which is arranged for communication such as for example mobile telephones, pagers, communicators, that is to say so called organizers with inbuilt telephones and telefax and printer apparatuses. Said equipment can be used in some type of radio network, such as for example cellular networks, satellite networks or smaller, local networks.

Today there are several types of antenna on the market, such as for example helical antennas, telescopic antennas, swivel antennas and ceramic antennas.

An helical antenna is a spiral shaped antenna of which the characteristics, amongst others depend on the length of the antennas and the pitch and diameter of the antenna spiral. Helical antennas are advantageous to use in mobile telephones because they are small and compact.

A telescopic antenna is an antenna which can be extended and retracted and/or pushed into a mobile telephone. When a mobile telephone is used the antenna is extended whereby good receiving sensitivity is obtained. When the mobile telephone is not used then the antenna is pushed whereby the mobile telephone becomes compact and easily fits into a pocket. In the retracted position the receiving sensitivity is however very bad. There is consequently a risk that an incoming call request cannot be received by the mobile telephone when the antenna is retracted.

A swivel antenna is an antenna which either can be in a raised-up position or a folded-down position. When the mobile telephone is used the antenna is raised up whereby good receiving sensitivity is obtained. When the mobile telephone is not used then the antenna is folded down whereby the mobile telephone becomes compact and easily fits into a pocket. In the folded-down position the receiving sensitivity is, however, very bad. There is consequently a risk that an incoming call request cannot be received by the mobile telephone when the antenna is folded down.

It is known to arrange a helical antenna on a telescopic antenna. Such an antenna arrangement comprises consequently two antennas, which generally can be called the primary antenna and the secondary antenna. The two antennas can be connected to the radio circuits of the mobile telephone via a connecting and disconnecting function between the telescopic antenna, helical antenna and the radio circuits of the telephone. The connecting and disconnecting function is controlled by the telescopic antenna's position (extended respectively retracted). The connecting and disconnecting function can be obtained in many different ways, with respect to how this is brought about and what it results in.

In EP 0 668 060 A1 an antenna arrangement is described comprising an telescopic antenna and a helical antenna which can be connected to the radio circuits depending on the position of the extendable antenna, wherein only one antenna at the time is connected to the radio circuits.

In EP 0 676 824 A1 another antenna arrangement is described comprising a telescopic antenna. The antenna arrangement also comprises a spool which functions as an impedance matching element when the telescopic antenna is extended and as a helical antenna when the telescopic antenna is retracted.

In EP 0 516 490 A2 a further antenna arrangement is described comprising an telescopic antenna and a helical antenna. According to this construction the telescopic antenna is used as a coaxial conductor to the helical antenna when the telescopic antenna is in the retracted position.

In WO 94/28593 and also in WO 94/10720 is further described an antenna arrangement comprising a telescopic antenna and the helical antenna. The helical antenna is always connected to the radio circuits and the telescopic antenna is only connected to the radio circuits when it is extended.

All the above mentioned constructions describe a straight telescopic antenna with which a helical antenna is arranged. The helical antenna is concentrically arranged by the telescopic antenna according to many of the constructions. The constructions describe different variants of complicated combinations of primary antenna, secondary antenna and a connecting and disconnecting function. No construction shows a simple solution to the problem of arranging a compact antenna device which has good receiving sensitivity.

DISCLOSURE OF THE INVENTION

The present invention tackles a problem of how an antenna device, comprising a primary antenna and a secondary antenna, for a portable radio equipment is to be produced which has good receiving sensitivity and at the same time is compact. Yet another problem is how the antenna device shall be produced in a simple manner. Included in said problem is how to produce a simple connecting and disconnecting function for the connection of the primary antenna and secondary antenna to the radio circuits of the radio equipment.

Yet another problem is how the antenna device shall be produced so that different types of primary antennas and secondary antennas can be used. For example a swivel antenna or a telescopic antenna can be used as the primary antenna and for example a helical antenna, an f-antenna, a ceramic antenna or a patch antenna can be used as the secondary antenna.

An object with the present invention is consequently to produce an antenna device for portable radio equipment which antenna device has good receiving sensitivity and at the same time is compact.

Yet another object is to produce a simple connecting and disconnecting function for connecting a primary antenna and a secondary antenna to the radio circuits of the portable radio equipment so that the antennas can cooperate irrespective of which type of primary antenna and secondary antenna is used.

According to the invention a solution to the above problem is to produce an antenna device which comprises a primary antenna and a secondary antenna, wherein only the primary antenna is connected to the radio circuits when the primary antenna is in a first position and wherein both primary antenna and secondary antenna are connected to the radio circuits when the primary antenna is in a second position.

The antennas are connected to the radio circuits via an antenna connection. The primary antenna is in contact with the antenna connection when it is in the first and the second position. The secondary antenna is brought into contact with the antenna connection with the help of a switching means when the primary antenna takes up the second position whereby the primary antenna and secondary antenna are connected in parallel with each other.

An advantage with the invention is that the antenna device at the same time has good receiving sensitivity and is compact.

Yet another advantage is that the antenna device is easy to realize.

Yet another advantage is that the antenna device can be realized with different types of primary antennas and secondary antennas. The primary antenna can for example be a swivel antenna or a telescopic antenna. The secondary antenna can for example be a helical antenna, an f-antenna, a ceramic antenna or a so called patch antenna.

The invention will now be described more closely with the help of preferred embodiments and with reference to the appended drawings.

PREFERRED EMBODIMENTS

Figure 1:
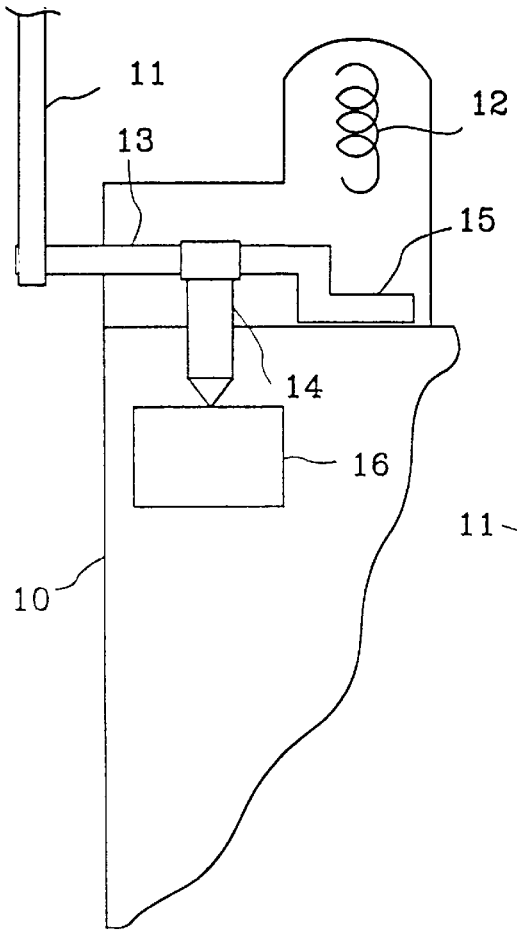
FIG. 1 shows schematically a first embodiment of an antenna device according to the present invention, which is mounted on a mobile telephone. The primary antenna is shown in the raised-up position.

FIG. 1 shows schematically a first embodiment of an antenna device according to the present invention. The antenna device is shown mounted on a portable radio equipment 10 which in this example is a mobile telephone. The antenna device comprises a primary antennna 11 and a secondary antenna 12. The primary antenna in this example is a swivel antenna and the secondary antenna is a helical antenna. The primary antenna can be used during calls in progress and can be said to be a conversation antenna or active antenna. The secondary antenna can be used when the mobile telephone is ready for reception of and incoming call request and can be said to be a paging antenna.

The primary antenna 11 can be connected to the radio circuits of the mobile telephone via a rotatable shaft 13 and an antenna connection 14. The secondary antenna 12 can be connected to the radio circuits 16 of the mobile telephone via a switching means 15, shaft 13 and antenna connection 14.

In FIG. 1 is primary antenna 11 is shown in a first or raised-up position, wherein the primary antenna is connected to the radio circuits and wherein the secondary antenna is not connected to the radio circuits. The primary antenna is in this position, the conversation position or active position, during the call in progress, whereby good receiving sensitivity is obtained.

When the conversation is finished the antenna 11 can be folded down whereby the mobile telephone becomes very compact. The mobile telephone can then without problem be stored in, for example, a pocket. When the primary telephone is folded down into the second or folded-down position (the mobile telephone is in the paging position) the shaft 13 rotates which results in that the switching means 15 also rotates. In this way the switching means comes into contact with the secondary antenna 12.

Figure 2:
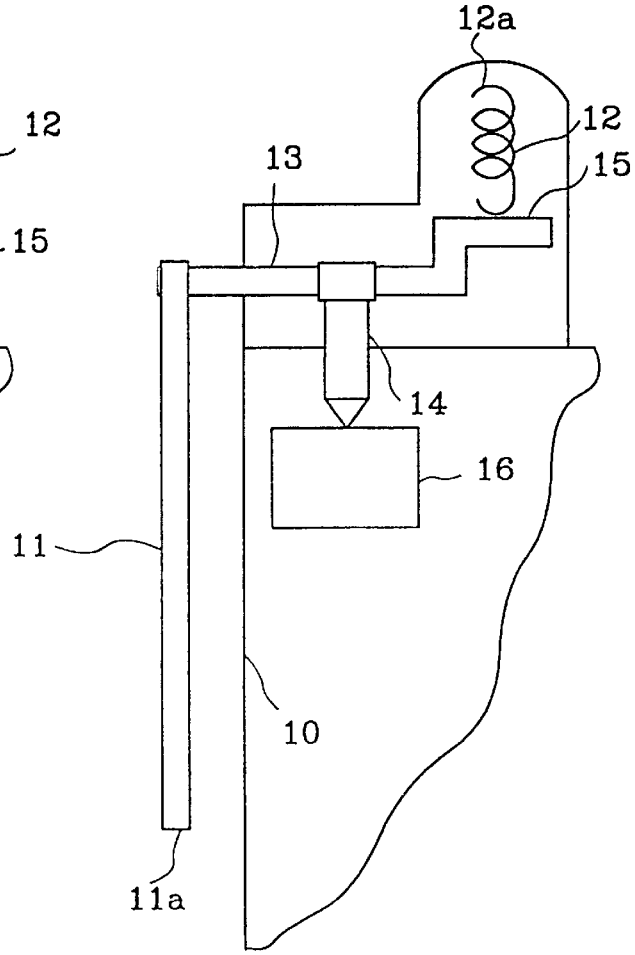
FIG. 2 shows schematically the antenna device of FIG. 1 wherein the primary antenna is shown in the folded-down position.

In FIG. 2 the primary antenna is shown in the folded-down position wherein the primary antenna is connected to the radio circuits wherein the secondary antenna is also connected to the radio circuits.

The primary antenna 11 has a bad receiving sensitivity in the folded-down position. The bad receiving sensitivity in the folded-down position is caused by the primary antenna coming into the vicinity of the earth plane of the mobile telephone. An earth plane can, for example, be formed by the earth shieldings of the circuits in the mobile telephone or by the earth casing of the mobile telephone.

According to the invention the primary antenna 11 and secondary antenna 12 cooperate for the receiving sensitivity when the primary antenna is in the folded-down position. The antennas are connected in parallel with each other through both having an open end 11*a*, 12*a* and through the other ends of the antennas being connected to the radio circuits 16.

Figure 3:
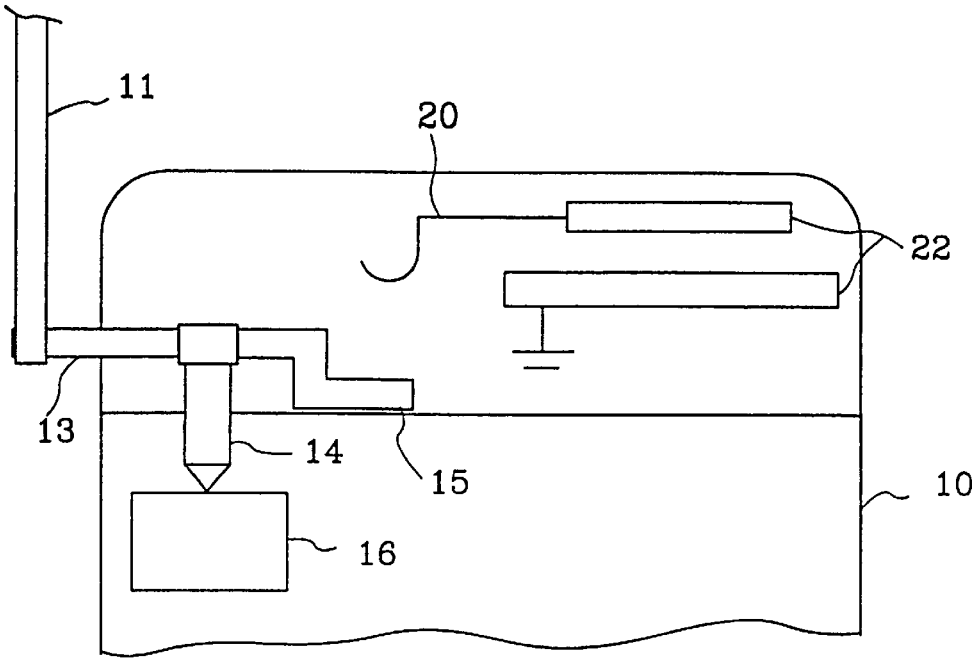
FIG. 3 shows schematically a second embodiment of an antenna device according to the present invention, which is mounted on a mobile telephone. The primary antenna is shown in the raised-up position.

FIG. 3 shows schematically a second embodiment of an antenna device according to the present invention. The antenna device is shown mounted on a mobile telephone 10. The antenna device comprises a primary antenna 11 and a secondary antenna 22. The primary antenna in this example is a swivel antenna and the secondary antenna is a patch antenna.

In the same way as earlier the primary antenna is connected to the radio circuits of the mobile telephone by a rotatable shaft 13 and an antenna connection 14. The secondary antenna can be connected to the mobile telephone radio circuits 16 via a switching means 15, the shaft 13 and a connection means 20.

FIG. 3 shows the primary antenna 11 in a first or raised-up position, wherein the primary antenna is connected to radio circuits 16 and wherein the secondary antenna 22 is not connected to radio circuits. The primary antenna is in this position during calls in progress whereby good receiving sensitivity is obtained.

When the primary antenna is folded down to a second or folded-down position then the shaft 13 rotates which results in that also the switching means 15 rotates. In this way the rotation means will come into contact with the connecting means 20 of the secondary antenna 22. The connecting means 20 can be some type of contact foil which the switching means 15 comes into contact when the primary antenna is folded down so that the shaft 13 rotates.

Figure 4:
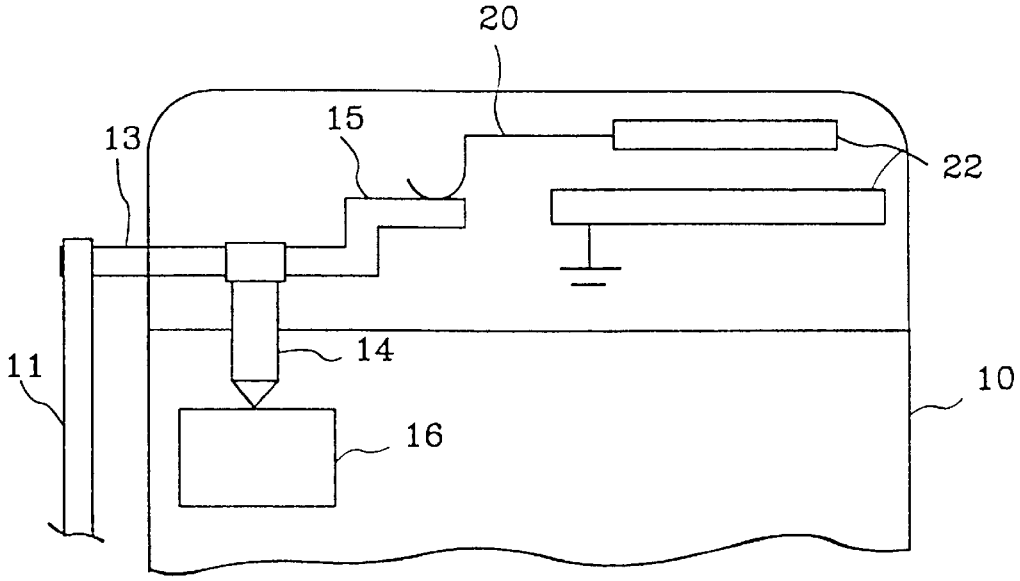
FIG. 4 shows schematically the antenna device in FIG. 3 wherein the primary antenna is shown in the folded-down position.

FIG. 4 shows the primary antenna in the folded down position in which the primary antenna is connected to the radio circuit and in which the secondary antenna is also connected to the radio circuit.

As mentioned earlier the primary antenna 11 has bad receiving sensitivity in the folded down position. The above described cooperation between the primary antenna and secondary antenna is irrespective of the type of antenna of the respective antennas, whereby good receiving sensitivity is obtained even when the secondary antenna is a patch antenna. Furthermore the antennas are parallel connected with each other when the primary antenna is folded down through them both having an open end and through the other ends of the antennas being connected to the radio circuits 16.

Figure 5:
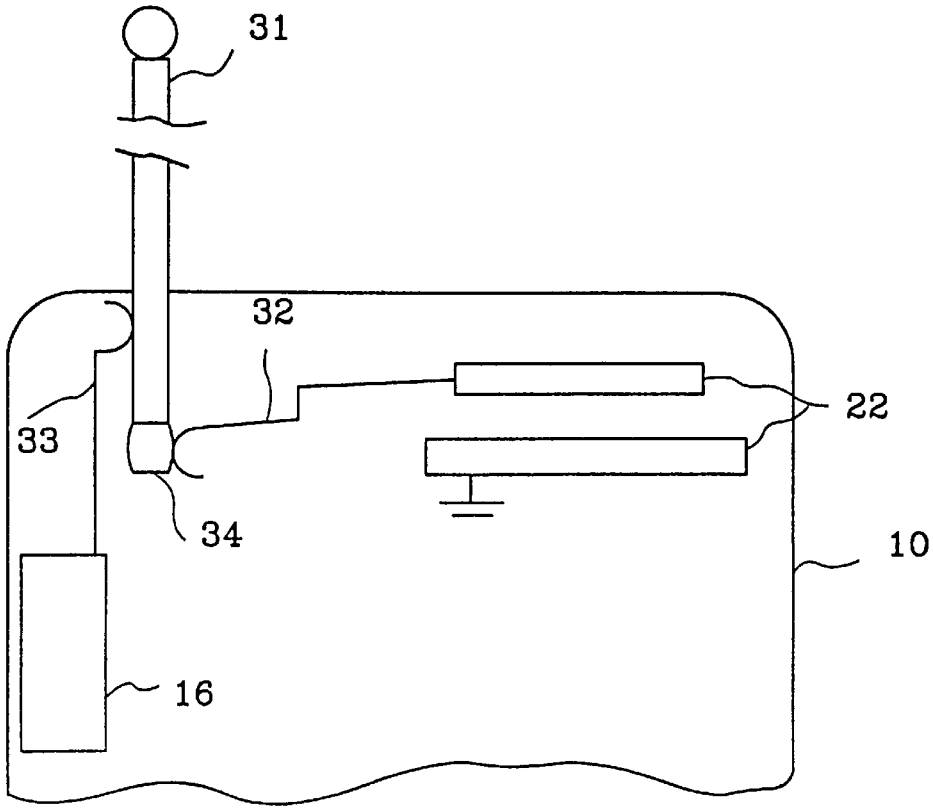
FIG. 5 shows schematically a third embodiment of the antenna device according to the present invention which is mounted on a mobile telephone. The primary antenna is shown in the extended position.

FIG. 5 shows schematically a third embodiment of an antenna device according to the present invention. The antenna device is shown mounted on a mobile telephone 10. The antenna device comprises a primary antenna 31 and a secondary antenna 22. The primary antenna in this example is a telescopic antenna and the secondary antenna is a patch antenna.

According to the present example of an embodiment the primary antenna 31 can be connected to the radio circuits 16 of a mobile telephone via en antenna connection 33. The secondary antenna 22 can be connected to the radio circuits 16 of the mobile telephone via a switching means which can be produced by means of a contact means 33 and an insulating means 34. The antenna connection 33 and contact means 32 can be some type of contact foil which can be brought into contact with the primary antenna when it takes up the first and second positions. The insulating means is arranged by the primary antenna so that the contact means 32 is brought out of contact with the primary antenna and instead is in contact with said means 32 when the primary antenna is in the first position.

In FIG. 5 the primary antenna 31 is shown in a first or extended position whereby the primary antenna is connected to the radio circuits and whereby the secondary antenna is not connected to the radio circuits. The primary antenna is in this position during calls in progress whereby good receiving sensitivity is obtained. The contact means 32 is not in contact with the primary antenna because it is in contact with the insulating means 34.

Figure 6:
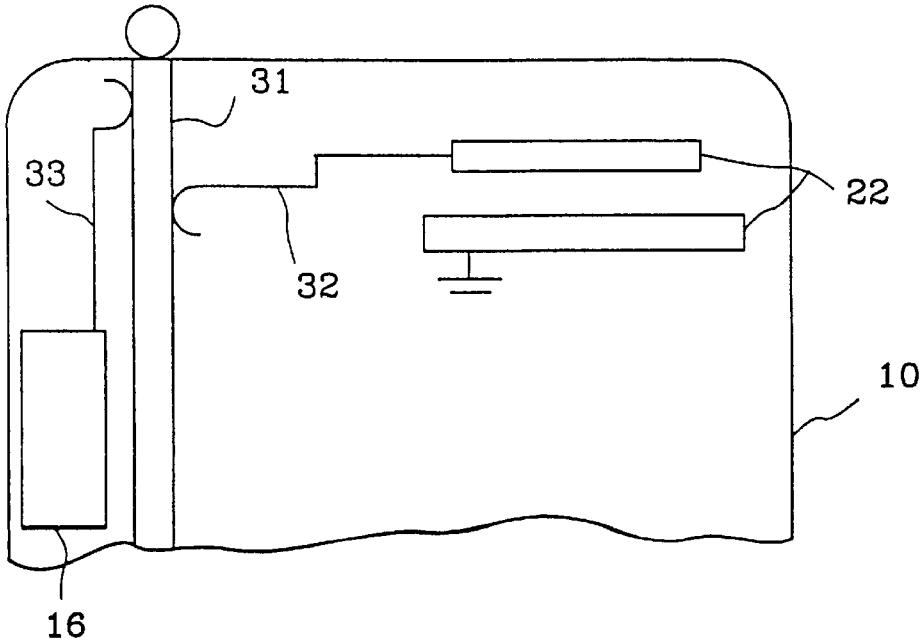
FIG. 6 shows schematically the antenna device in FIG. 5, wherein the primary antenna is shown in the retracted position.

In FIG. 6 the primary antenna is shown in the second or retracted position wherein the primary antenna is connected to the radio circuits and wherein the secondary antenna is also connected to the radio circuits.

When the primary antenna is pushed in to the second position the antenna connection 33 will slide along the antenna whereby the primary antenna will remain connected to the radio circuits. The contact means 32 will not come so far as to come into contact with the insulating means 34 but instead will be brought into contact with the primary antenna wherein the secondary antenna is connected to the radio circuits.

As mentioned earlier the primary antenna 31 has bad receiving sensitivity in the retracted position. The above described cooperation between the primary antenna and the secondary antenna is irrespective of the antenna type of the respective antennas whereby good receiving sensitivity is obtained even when the primary antenna is a telescopic or collapsible antenna and the secondary antenna is a patch antenna. Furthermore, the antennas are connected in parallel with each other when the primary antenna is folded down through them having an open end and through the other ends of the antennas being connected to the radio circuits 13.

Figure 7:
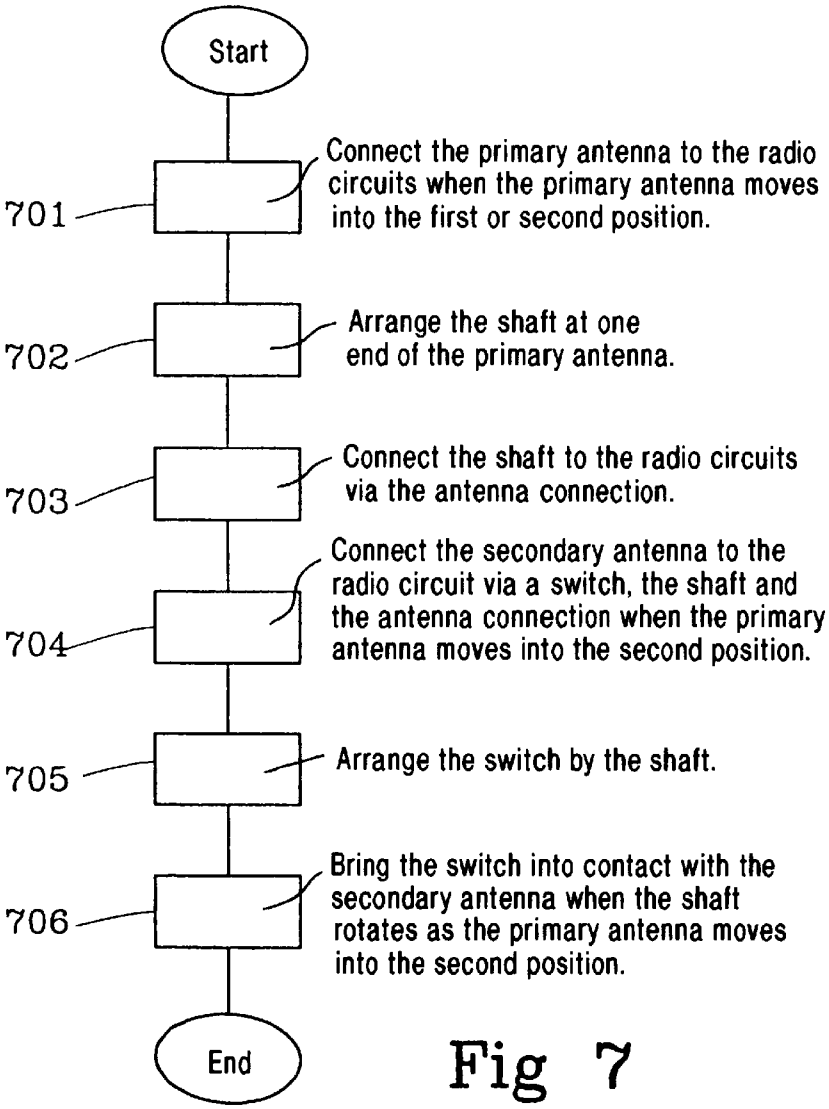
FIG. 7 shows a schematic flow diagram over a method according to the first embodiment of the invention.

In FIG. 7 a schematic flow diagram of a method according to the first embodiment of the invention is shown. The method produces an antenna device in a portable radio equipment 10 which comprises a primary antenna 11, 31 and a secondary antenna 12, 22. The primary antenna can take up a first position and a second position as described above. According to the first embodiment the method comprises the steps (see also FIGS. 1 and 2):

to connect the primary antenna 11 to the radio circuits 16 via a rotatable shaft 13 and an antenna connection 14 when the primary antenna 11 takes up the first position and when the primary antenna 11 takes up the second position, step 701 in FIG. 7, to arrange the shaft 13 at one end of the primary antenna, step 702 in FIG. 7, to connect the shaft to the radio circuits 16 via the antenna connection 14, step 703 in FIG. 7, to connect the secondary antenna 12 to the radio circuit 16 via a switching means 15, the rotatable shaft 13 and the antenna connection 14 when the primary antenna 11 takes up the second position, step 704 in FIG. 7, to arrange the switching means 15 by the rotatable shaft 13, step 705 in FIG. 7, and to bring said means 15 into contact with the secondary antenna 12 when the shaft rotates as a consequence of the primary antenna taking up the second position, step 706 in FIG. 7.

Figure 8:
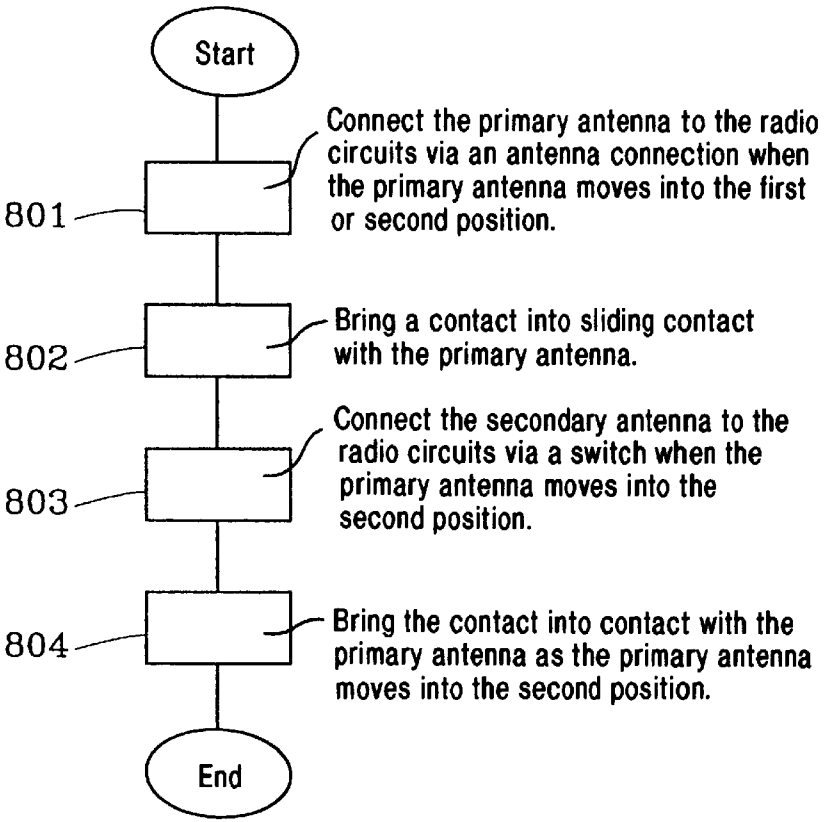
FIG. 8 shows a schematic flow diagram of a method according to the third embodiment of the invention.

In FIG. 8 a schematic flow diagram of a method according to the third embodiment of the invention is shown. According to this embodiment the method comprises the steps (see FIGS. 5 and 6 also):

of connecting the primary antenna 31 to the radio circuits 16 via an antenna connection when the primary antenna 31 takes up the first position and when the primary antenna 31 takes up the second position, wherein the antenna connection comprises a contact means 33, step 801 in FIG. 8, of bringing the contact means 33 into sliding contact with the primary antenna, step 802 in FIG. 8, of connecting the secondary antenna 22 to the radio circuits 16 via a switching means when the primary antenna takes up the second position, whereby the switching means comprises a contact means 32 and an insulating means 34, step 803 in FIG. 8, and of bringing the contact means 32 into contact with the primary antenna 31 as a consequence of the primary antenna taking up the second position, step 804 in FIG. 8.

The invention is naturally not limited to the embodiments described above and shown in the drawings, but can be modified within the scope of the appended claims.

What is claimed is:

1. Antenna device for a portable radio equipment comprising.

a primary antenna; and a secondary antenna; wherein the primary antenna can be placed in a first position and in a second position, characterized in that the primary antenna is connected to a radio circuit of said radio equipment and the secondary antenna is not connected to the radio circuit when the primary antenna is in the first position and that both the primary antenna and the secondary antenna are connected in parallel to the radio circuit when the primary antenna is in the second position.

2. Antenna device according to claim 1, wherein the primary antenna is connected to the radio circuit via a rotatable shaft and an antenna connection both when the primary antenna takes up the first position and the secondary position, wherein the shaft is arranged at one end of the primary antenna and is connected to the radio circuit via the antenna connection.

3. Antenna device according to claim 1, wherein the secondary antenna is connected to the radio circuit via a switching means, a rotatable shaft and an antenna connection when the primary antenna is in the second position, wherein the switching means is arranged by the rotatable shaft and is brought into contact with the secondary antenna when the shaft rotates as a consequence of the primary antenna moving into the second position.

4. Antenna device according to claim 1, wherein the primary antenna is a swivel antenna, whereby folding up the primary antenna moves the primary antenna into the first position and folding down the primary antenna moves the primary antenna into the second position.

5. Antenna device according to claim 1, wherein the primary antenna is connected to the radio circuit via an antenna connection when the primary antenna is in each of the first and second positions, wherein the antenna connection comprises a contact means which is brought into sliding contact with the primary antenna when the primary antenna is moved into the first and second positions.

6. Antenna device according to claim 1, wherein the secondary antenna is connected to the radio circuit via a switching means when the primary antenna is in the second position, wherein the switching means comprises a contact means and an insulating means and wherein the contact means is brought into contact with the primary antenna as a consequence of the primary antenna moving into the second position.

7. Antenna device according to claim 1, wherein the primary antenna is a telescopic antenna and wherein extending the primary antenna moves the primary antenna into the first position and retracting the primary antenna moves the primary antenna into the second position.

8. Antenna device according to claim 1, wherein when the primary antenna is in the second position, the primary antenna forms a transmission circuit and a conductor of the transmission circuit and an earth plane of said radio equipment forms the earth of the transmission circuit.

9. Antenna device according to claim 1, wherein the primary antenna and secondary antenna are connected in parallel with each other to the radio circuit when the primary antenna is in the second position.

10. Antenna device according to claim 1, wherein the secondary antenna is a compact antenna comprising antennas of the types helical antenna, patch antenna, ceramic antenna and f-antenna.

11. Method for arranging an antenna device for a portable radio equipment, which antenna device comprises a primary antenna and a secondary antenna, wherein the primary antenna can be placed in a first position and in a second position, characterized of the steps of:

connecting the primary antenna and secondary antenna to a radio circuit of said radio equipment in such a way that the primary antenna is connected to the radio circuit and the secondary antenna is not connected to the radio circuit when the primary antenna is in the first position and that both the primary antenna and the secondary antenna are connected in parallel to the radio circuit when the primary antenna is in the second position.

12. Method according to claim 11, comprising the steps of:

connecting the primary antenna to the radio circuit via a rotatable shaft and an antenna connection when the primary antenna moves into the first position and when the primary antenna moves into the second position, of arranging the shaft at one end of the primary antenna, connecting the shaft to the radio circuit via the antenna connection, connecting the secondary antenna to the radio circuit via a switching means, the rotatable shaft and the antenna connection when the primary antenna moves into the second position, arranging the switching means by the rotatable shaft, and bringing said switching means into contact with the secondary antenna when the shaft rotates as a consequence of the primary antenna moving into the second position.

13. Method according to claim 11, further comprising the steps of:

connecting the primary antenna to the radio circuit via an antenna connection when the primary antenna moves into the first position and when the primary antenna moves into the second position, wherein the antenna connection comprises a contact means, bringing the contact means into sliding contact with the primary antenna, connecting the secondary antenna to the radio circuit via a switching means when the primary antenna moves into the second position wherein the switching means comprises a contact means and an isolating means, and bringing the contact means into contact with the primary antenna as a consequence of the primary antenna moving into the second position.

14. Method according to claim 11, further comprising the step of:

connecting the primary antenna and secondary antenna parallel with each other to the radio circuit when the primary antenna moves into the second position.

* * * * *